United States Patent [19]

Satmer et al.

[11] Patent Number: 5,034,035

[45] Date of Patent: Jul. 23, 1991

[54] DEVICE FOR PREPARING BULK MATERIAL WITH A DUST REMOVAL ARRANGEMENT

[75] Inventors: Franz Satmer, Schaffhausen, Switzerland; Ernst Trondle, Immendingen, Fed. Rep. of Germany

[73] Assignee: George Fischer AG, Switzerland

[21] Appl. No.: 624,203

[22] Filed: Dec. 6, 1990

[30] Foreign Application Priority Data

Dec. 15, 1989 [CH] Switzerland ..... 04527/89

[51] Int. Cl.[5] ..... B01D 39/10

[52] U.S. Cl. ..... 55/193; 55/443; 55/321; 209/152; 241/74; 241/DIG. 10

[58] Field of Search ..... 55/192, 193, 198, 207, 55/320, 323, 442–444; 209/152, 281, 288, 294, 324, 473; 210/402; 241/74, DIG. 10

[56] References Cited

U.S. PATENT DOCUMENTS

| | | | |
|---|---|---|---|
| 3,862,719 | 1/1975 | Muller | 241/74 |
| 3,958,764 | 5/1976 | Carpenter et al. | 241/74 |
| 4,274,360 | 6/1981 | Hofmann et al. | 241/DIG. 10 X |

*Primary Examiner*—Charles Hart
*Attorney, Agent, or Firm*—Bachman & LaPointe

[57] ABSTRACT

Arranged in the upper region of a drum which rotates about an axis there is a dust box for dust removal. The box is connected with a line, which leads outwards, by way of a laterally arranged discharge channel. Arranged between the dust box and a baffle rotor which rotates about the axis are baffle areas which form labyrinth-like passages for the dust to the dust suction openings in the dust box.

9 Claims, 2 Drawing Sheets

DEVICE FOR PREPARING BULK MATERIAL WITH A DUST REMOVAL ARRANGEMENT

BACKGROUND OF THE INVENTION

The invention relates to a device for preparing bulk material, in batch quantities, having a drum which can be rotated about a horizontal axis, a baffle rotor within the drum and a dust removal arrangement comprising a suction box arranged within the drum having a suction pipe extending outside the drum.

Such a device has become known through DE-C2-29 09 408, which device has a suction box in the drum interior for the removal of dust.

The openings in the suction box for the suction current lie directly behind a down-draught which is generated by a stripper and meets with the baffle rotor. As a result of this arrangement, a comparatively large amount of bulk material or sand, as the case may be, is also removed by suction in addition to the dust, this bulk material or sand being lost with regard to future use.

It is the principle object of the present invention to provide a device as aforesaid which renders possible optimum removal of dust from the interior space of the drum with the least possible sand loss and suction power.

SUMMARY OF THE INVENTION

The foregoing object is achieved by way of the present invention wherein the suction box is formed in a curved manner, with dust suction openings being arranged on a wall facing the drum center and baffle areas are arranged between the suction box and the baffle rotor such that labyrinth-like passages to the suction openings are formed for the dust.

As a result of the curved construction of the suction box and the dust suction openings which are directed to the center of the drum, a suction current develops outside the down-draught generated by the stripper while, on account of the large suction area, only a comparatively low suction current speed is required.

The result of the labyrinth-like arrangement of the baffle areas between the suction box and the rotor is that as few sand particles as possible, which have been centrifuged away by the baffle rotor, reach the suction box and are sucked in there as well.

BRIEF DESCRIPTION OF THE DRAWINGS

The invention is represented by way of example in the enclosed drawings and described in the following.

DETAILED DESCRIPTION

Figure 1:
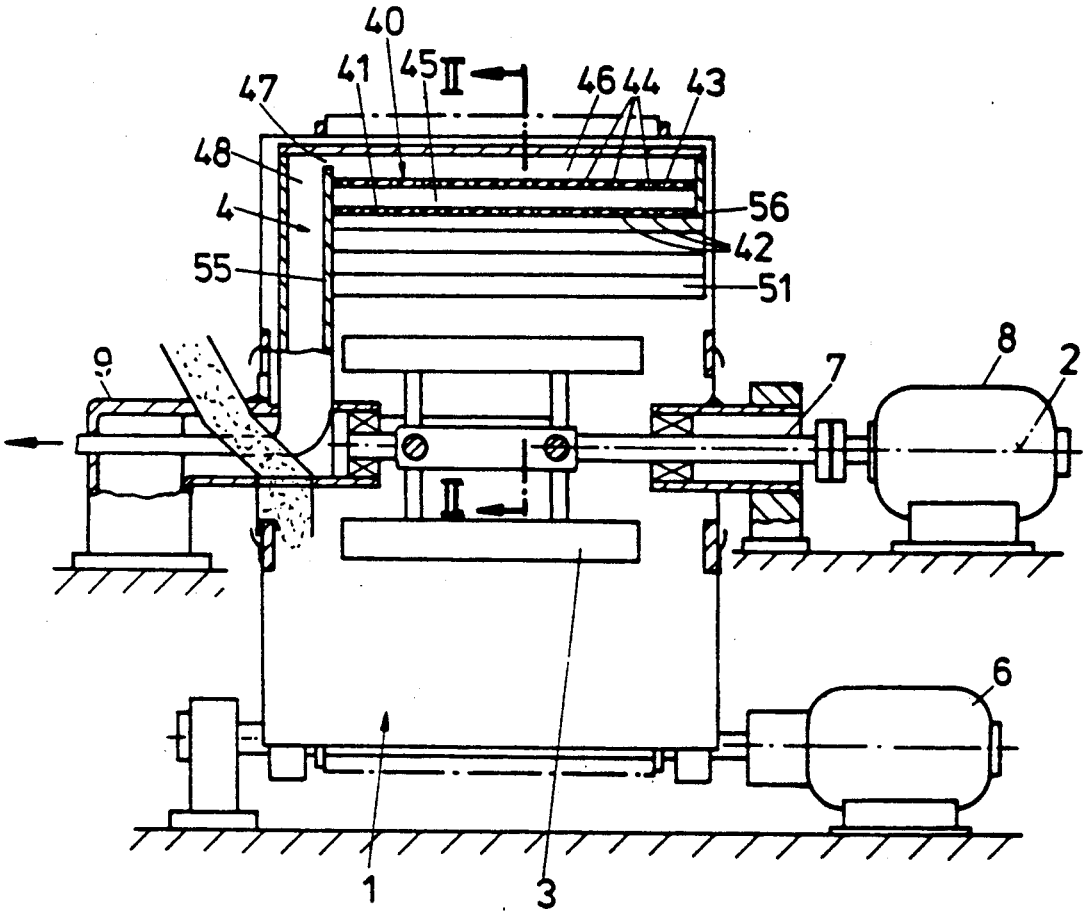
FIG. 1 shows a longitudinal section of the device along the drum axis in a simplified representation.
Figure 2:
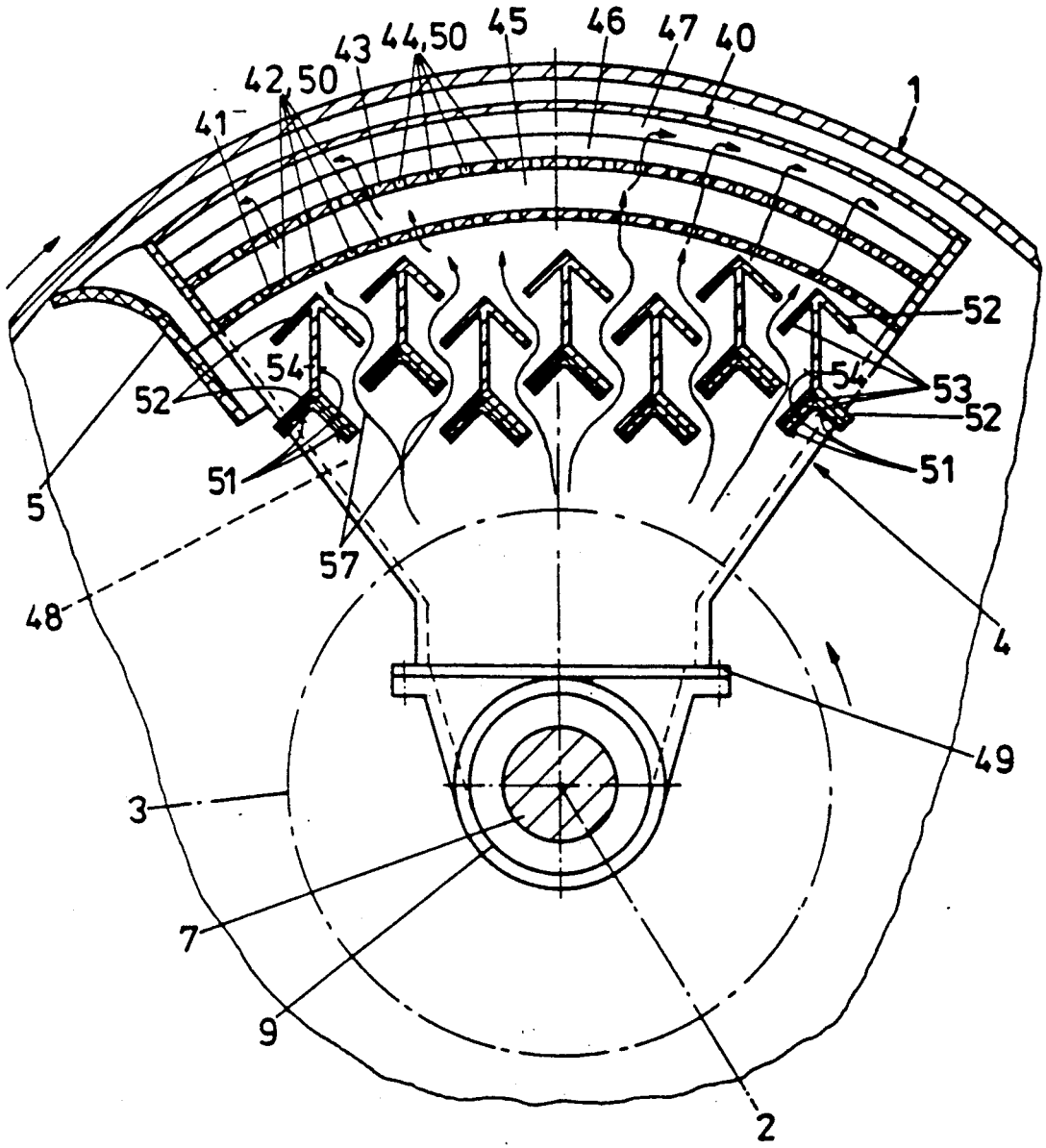
FIG. 2 shows a section along the line II—II in an enlarged representation.

The represented device which operates with batch quantities for the purpose of handling bulk material, more particularly foundry sands, essentially consists of a drum 1, which rotates about a horizontal axis 2, a baffle rotor 3, a dust removal arrangement 4 and a stripper 5 which is shown in FIG. 2. The drum is driven by a motor 6.

There is mounted coaxially to the drum axis 2 a shaft 7 which is driven by a motor 8 at a comparatively high speed and supports the baffle rotor 3 in the interior of the drum 1.

The dust removal arrangement 4 has a suction box 40 which is formed in a curved manner. The suction box 40 is arranged at a short distance from the inner peripheral area of the drum 1 and is formed in cross section as a partial circular ring. The inner wall 41 of the suction box 40 directed to the center of the drum has dust suction openings 42. An intermediate wall 43 which runs parallel to the latter with through-openings 44 divides the suction box 40 into an inner chamber 45 and an outer chamber 46.

The two walls 41, 43 are preferably formed as perforated metal sheets. The outer chamber 46 is connected, by means of a lateral opening 47, with a discharge channel 48 which is arranged at one lateral end of the suction box 40. The discharge channel 48 is formed, according to FIG. 2, substantially as a segment of a circle in cross section and is secured by means of a flanged connection 49 to a tubular holding portion 9. In the interior of the holding portion 9 the discharge channel 48 is connected with a fan, by means of a line, via a filter unit.

The holes 50 of the perforated metal sheets forming the openings 42 and 44 are formed with differing diameter in the direction along the drum axis. Starting from the lateral discharge channel 48 as far as the opposing end of the chambers 45, 46, the holes 50 are formed so as to become continuously larger in diameter, whereby uniform dust discharge is achieved over the whole discharge width of the drum, despite the fact that the discharge channel 48 is arranged on one side of the suction box 40.

There are arranged between the suction box 40 and the rotor 3 baffle areas 51 between which labyrinth-like passages 57 to the suction openings 42 are arranged for the dust. The baffle areas 51 are formed by the legs 53 of angle sections 52 which are arranged in several rows with legs 53 open to the interior space of the drum.

In the case of the exemplary embodiment represented, four rows of angle sections 52 are arranged so as to be offset in relation to each other, the angle sections 52 of the first and third row and also the second and fourth row respectively being connected with vertically arranged metal sheets 54 which form additional baffle areas 51. The angle sections 52 are secured between one side wall 55 of the discharge channel 48 and an opposite metal sheet 56 which is arranged at the end of the suction box 40.

The baffle areas 51 of the two lower rows of angle sections 52, upon which the bulk material acts most vigorously, are coated with rubber for the purpose of reducing wear.

In addition to the use of fixedly arranged angle sections as baffle areas, differently arranged metal sheets can be used. These can also be formed so as to be swingable about a point of rotation in order to achieve, through adjustability, good dust removal with small proportions of sand.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for preparing bulk material, in batch quantities, having a drum which can be rotated about a horizontal axis, having a baffle rotor and having a dust removal arrangement which has a suction box arranged within the drum with a suction pipe which leads outwards, wherein a suction box is formed in a curved manner, with dust suction openings being arranged on a wall facing the drum center and baffle areas are arranged between the suction box and the baffle rotor such that labyrinth-like passages to the suction openings are formed for the dust.

2. A device according to claim 1 wherein the suction box is divided by means of an intermediate wall, provided with through openings, into an inner and an outer chamber.

3. A device according to claim 2 wherein the outer chamber is connected, by means of a lateral opening, with a discharge channel which is secured to a lateral end of the suction box.

4. A device according to claim 3 wherein the openings in the walls are formed such that, starting from the lateral discharge opening as far as the opposing end of the chambers, they become continuously larger in cross section in order to achieve uniform dust discharge over the whole discharge width in the drum.

5. A device according to claim 2 wherein the wall with the suction openings and the intermediate wall are formed as perforated metal sheet.

6. A device according to claim 1 wherein the baffle areas are formed by the legs of angle sections.

7. A device according to claim 6 wherein the angle sections are arranged in at least two rows, in each case offset in relation to each other, with legs open to the interior space of the drum.

8. A device according to claim 6 wherein additional baffle areas are formed by, in each case, metal sheets which are arranged between two angle sections.

9. A device according to claim 1 wherein at least one portion of the baffle areas is coated with rubber or plastic material.

* * * * *